US006162509A

United States Patent [19]

Cherico et al.

[11] Patent Number: 6,162,509

[45] Date of Patent: Dec. 19, 2000

[54] HIGH FREQUENCY INDUCTION FUSING

[75] Inventors: Stephen D. Cherico, N. Olmstead; Naiping D. Zhu, Strongsville, both of Ohio; Valentin S. Nemkov, Auburn Hills, Mich.

[73] Assignee: Fosbel International Limited, Swindon, United Kingdom

[21] Appl. No.: 09/124,076

[22] Filed: Jul. 29, 1998

[30] Foreign Application Priority Data

Jul. 30, 1997 [GB] United Kingdom ..... 9716032
Sep. 26, 1997 [GB] United Kingdom ..... 9720489

[51] Int. Cl.[7] ..... C23C 4/08; C23C 4/18; B05D 3/02

[52] U.S. Cl. ..... 427/456; 427/543; 427/455; 427/453; 427/427

[58] Field of Search ..... 427/456, 543, 427/453, 455, 427; 219/603, 633

[56] References Cited

U.S. PATENT DOCUMENTS 4,024,617 5/1977 McCormick ..... 427/456
5,128,172 7/1992 Whittick ..... 427/321

FOREIGN PATENT DOCUMENTS 8-253854 10/1996 Japan .

OTHER PUBLICATIONS

"The Induction Fusion of Sprayed Self–Fluxing Alloys"; Eisenhardt et al; paper 49, 9th International Thermal Spraying Conference, May, 1980.

"Interface Morphology of Iron–Base Sulffusing Alloy Coating with Induction–Refusing"; Junling et al; Proceedings of ITSC 95, Kobe, May, 1995, pp. 537 through 541.

"Application of Self–Fused Alloy Coating by HF Induction Heating", Matsubara et al; Proceedings of ITSC 95, Kobe, May, 1995, pp. 1001–1004.

*Primary Examiner*—Katherine A. Bareford
*Attorney, Agent, or Firm*—Nixon & Vanderhye P.C.

[57] ABSTRACT

A self-fusing alloy thermal spray coating or a vitreous ceramic coating is fused to a complicated metal shape or convoluted metal surface, such as a waterwall panel having a plurality of tubes interconnected by a plurality of membranes, without significant warpage or adverse change in the microstructure of the material forming the panel. The coating is first applied to the panel and then is heated to a liquidus temperature (typically between about 1000°–2200° F.), by induction at a frequency of greater than about 25 kHz, so as to effect fusing. An inductive coil assembly for this purpose comprises a copper tubular combined electrical current conductor and conduit for circulating cooling water having a first closed end and a second end connectable to a source of cooling fluid and a source of electricity. At least one, and preferably a plurality, of copper noses extend outwardly from the combined conductor and conduit and both conduct electricity and circulate cooling fluid. The noses extend substantially perpendicularly to the combined conductor and conduit and are configured so as to effect proper induction heating of the panel. A magnetic flux concentrator is preferably provided over at least some of the noses. Preheating noses (e.g. solid copper blocks) may be connected to a leading portion of the combined conductor and conduit.

21 Claims, 5 Drawing Sheets

HIGH FREQUENCY INDUCTION FUSING

BACKGROUND AND SUMMARY OF THE INVENTION

In the past fusing of thermal spray coatings on waterwalls has been accomplished by using a range of combustible gases (natural gas, propane, acetylene, propylene, etc.) and oxygen, and torch devices. The heat applied by the torch heats the coating and tube to the liquidus temperature of the coating, thus allowing the coating to "braze" onto the prepared surface of the waterwall to form a metallurgical bond. However, this process has a number of drawbacks. First it is difficult to fuse the membrane portion of the waterwall without overheating, burning, or melting off the coating from the sidewalls or crowns of the tubes. Another problem with torch fusing is the requirement for high amounts of heat (BTUs) to heat the waterwall to a sufficiently high temperature to allow the coating to reach its liquidus temperature. The high thermal conductivity and thermal mass of the waterwall pulls heat away from the coating very quickly. Only after the waterwall section has been heated throughout the tube thickness will the coating begin to fuse. As a result, the practice is to heat sufficiently to fuse the crowns of the tubes only, leaving the membranes unfused. This high heat input leads to warpage of the tubes and waterwall, as well as introducing potential microstructural changes into the tubes, which may have adverse effects on waterwall performance or usage. Attempts to cool tubes with water passing through the tubes were shown to pull the heat out of the system too quickly, as the torches provided too few BTUs to overcome the conduction of heat away from the area of concern. Thirdly, torch fusing techniques are also very time-consuming and difficult to control with any consistency.

Induction heating has been used to heat and fuse thermal spray coatings on individual straight tubes and rods in the past, but no record of using induction heat fusing on a complicated shape such as a waterwall panel is known. Previous efforts have focused on relatively low frequency (<10 kHz) usage of induction heating techniques. The result has been that heat penetration into the base material is greater, thereby increasing the possibility of overheating and warping the article. In the time frame of the prior work, higher frequency equipment, and hand-held transformers were not utilized for this application.

The invention comprises a method of providing a continuous fused coating over waterwall panels by means of a specially designed induction coil, which provides uniform heating to both waterwall tube and membrane; and the invention also relates to coil itself. The invention is particularly useful for fusing conventional formulations of self-fusing alloy thermal spray coatings, such as nickel based alloys, which may include other components such as boron and/or silicon, chrome, molybdenum, iron, titanium, chrome carbides, tungsten carbides, and others; however the invention is also applicable for use with vitreous ceramic coatings, such as compositions of low melting point frits with an inorganic binder.

According to one aspect of the present invention a method of fusing a self-fusing alloy thermal spray coating or a vitreous ceramic coating on a waterwall panel having a plurality of tubes interconnected by a plurality of membranes is provided. The method comprises the steps of: (a) Heating at least some portions of at least one membrane and adjacent tubes of the waterwall panel, by induction, to a liquidus temperature of a self-fusing alloy thermal spray coating or a vitreous ceramic coating without significant warpage or adverse change in the microstructure of the material forming the panel. And, (b) applying a self-fusing alloy thermal spray coating or a vitreous ceramic coating on the waterwall panel in such a way that the coating is fused at the heated portions of the panel.

Typically the waterwall has first and second faces (i.e. of the tubes), and steps (a) and (b) are repeated so as to fuse the coating substantially continuously over substantially the entire first face of the waterwall panel. The induction heating in step (a) is preferably practiced at a frequency of greater than about 25 kHz, and may be practiced utilizing a portable compact transformer connected to a main power supply (and step (a) may be practiced at a distance of more than thirty feet from the power supply). Preferably step (a) is practiced by concentrating induction energy in the membrane portion of the waterwall, and step (b) is practiced before step (a).

Step (a) may be practiced by moving an induction coil having noses roughly approximating the contour of the waterwall panel over the panel. The method may comprise the further step of circulating a cooling fluid through the induction coil during the practice of step (a). In one embodiment step (b) is practiced by applying a nickel based alloy having a coating thickness of from 3–40 mils, while in another step (b) is practiced by painting or spraying a composition of low melting point frits and an inorganic binder, in slurry form, with a thickness of between 3–15 mils; and there is the further step of air drying the coating before the practice of step (a). Step (a) is typically practiced so as to heat the coating to a temperature of between about 1000–2200° F.

Step (a) may be practiced by first passing a preheater coil assembly (which is typically a leading part of the fusion coil assembly), including a copper nose which extends down to the membrane without a flux concentrator, over the panel, and then passing a fusion coil assembly (which may be a trailing part of the preheater coil assembly), comprising a copper nose and magnetic flux concentrator which brings sufficient inductive energy to the membrane so that the coating on the membrane can be fused without overheating the coating on the tube, over the panel. It is also possible to fuse multiple tube-membrane configurations at once by increasing the size of the coil, and passing water through the tubes during the fusing process, as the induction coil provides heat to the coated surface faster than it can be extracted through the water.

According to another aspect of the present invention a method of fusing similar coatings on a complicated metal shape or convoluted metal surface, in general, is provided. The method comprises the steps of: (a) Applying a self-fusing alloy thermal spray coating or a vitreous ceramic coating on the complicated metal shape or convoluted metal surface so that the coating is fused at the heated portion thereof. And then (b) inductive heating at least a portion of the complicated metal shape or convoluted metal surface by induction at a frequency of greater than about 25 kHz to at least the liquidus temperature of the coating. The details of these steps, and any additional steps, are substantially as described above. In a preferred embodiment, step (b) is practiced by (i) first passing a preheater with at least one copper nose and without a flux concentrator so that it substantially conforms to the convoluted metal surface or complicated metal shape, and (ii) then passing over the surface or shape a fusion coil assembly having at least one copper nose with a magnetic flux concentrator substantially conforming to the convoluted metal surface or complicated metal shape so as to effect fusing; and wherein substeps (i) and (ii) are practiced using a unitary structure.

According to another aspect of the present invention an induction coil assembly is provided for practicing the methods as set forth above. The induction coil assembly comprises the following components: An electrically conductive material tubular combined electrical current conductor and conduit for circulating cooling fluid, and having a first closed end, and a second end connectable to a source of cooling fluid and a source of electricity. And, at least one electrically conductive material nose extending outwardly from the combined conductor and conduit and both conducting electricity and circulation cooling fluid, the nose extending substantially perpendicularly to the combined conductor and conduit, and the nose configured so as to effect induction heating of at least two differently configured portions of a complicated metal shape or convoluted metal surface.

The tubular combined conductor and conduit may be substantially quadrate (i.e. square or rectangle) in cross-section, or may be circular or oval in cross-section as well. A magnetic flux concentrator may be disposed on at least one of the at least one nose. The flux concentrator is connected to at least one of the nose and the combined conductor and conduit with a thermally conducive adhesive. The flux concentrator is preferably formed of magnetic particles and a dielectric material which serves as a binder and insulator which are pressed to form the shape thereof, or of a ferrite material. Preferably the combined conductor and conduit is copper and the nose is copper.

The coil is preferably used in combination with a transformer or capacitor station and a greater than about 25 kHz power supply electrically connected to the combined conductor and conduit. Usually a plurality of noses are provided, and the noses and combined conductor and conduit at a portion thereof approximate the surface configuration of a waterwall panel having a plurality of tubes connected by a plurality of membranes.

The coil assembly of the invention also typically comprises a plurality of coil positioners preferably spaced widely from each other and operatively connected to the combined conductor and conduit, for engaging the complicated metal shape or convoluted metal surface and guiding the at least one nose thereover so that the at least one fusing nose is properly positioned to effect induction heating of the shape or surface.

The tubular combined conductor and conduit may be in the form of a loop having a first portion which acts as a trailing portion in use, and a second portion which acts as a leading portion in use. The at least one nose for induction heating is on the first portion, and the assembly further comprises at least one preheating nose on the second portion. The at least one nose for induction heating typically includes a magnetic flux concentrator disposed thereon, and the at least one preheating nose comprises a solid block of copper brazed to the second portion, and devoid of a flux concentrator.

It is the primary object of the present invention to provide the efficient and effective fusing of thermal spray coatings and/or vitreous ceramic coatings on complicated metal shapes or convoluted surfaces, that need abrasion and corrosion protection, such as waterwall panels. This and other objects of the invention will become clear from an inspection of the detailed description of the invention and from the appended claims.

DETAILED DESCRIPTION OF THE DRAWINGS

Figure 1:
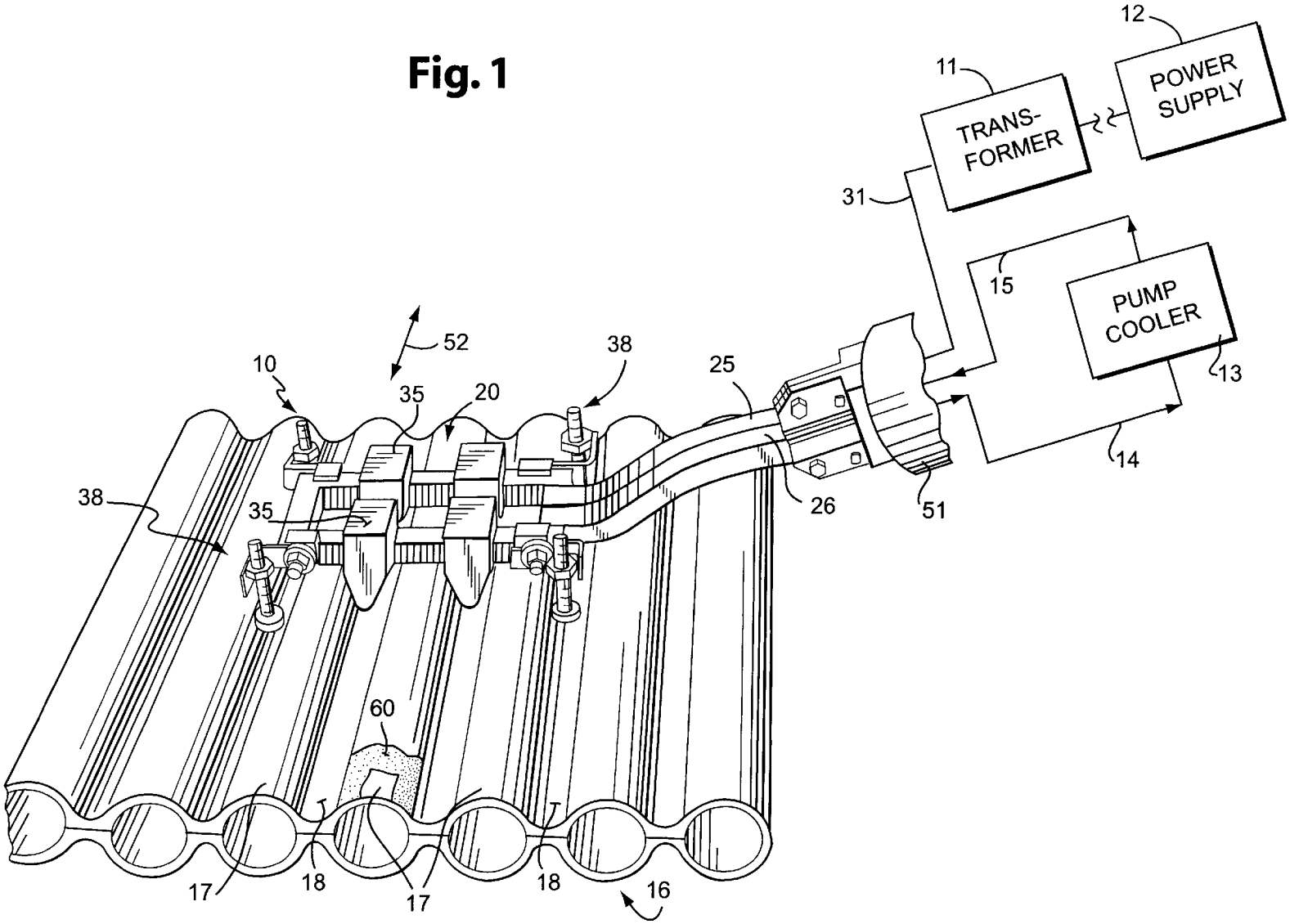
FIG. 1 is a partially schematic and partially perspective view of an exemplary induction coil assembly according to the present invention used to fuse a coating on a waterwall panel, and associated equipment.

An exemplary induction coil assembly for fusing an alloy thermal spray coating or a vitreous ceramic coating on a complicated metal shape or convoluted metal surface needing abrasion and corrosion protection is illustrated in perspective in FIG. 1, and is shown schematically connected up to equipment for use in association therewith. The induction coil assembly is shown generally by reference numeral 10 while various equipment to which it is preferably connected is shown schematically including a transformer 11, a high frequency induction power supply 12, and a pump/cooler assembly 13 with associated conduits 14 and 15.

Figure 2:
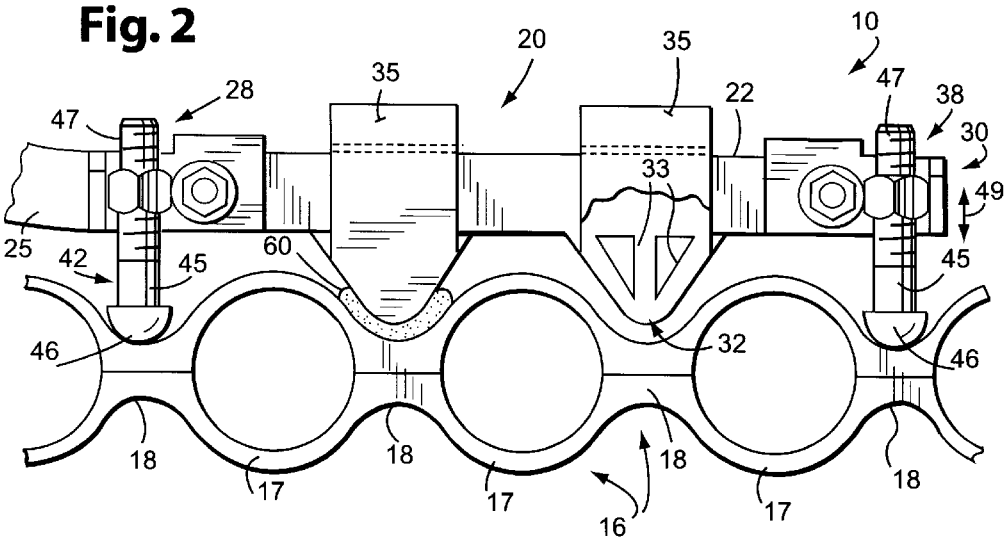
FIG. 2 is a side view of the induction coil assembly of FIG. 1 per se.

In FIGS. 1 and 2 the induction coil assembly 10 is shown in association with a waterwall panel shown generally by reference numeral 16, and including a plurality of metal tubes 17 interconnected by a plurality of membranes 18, all of metal. While the tubes 17 preferably are circular in cross-section, they can have other cross-sections, and the membranes 18 may be shaped differently than as illustrated in FIGS. 1 and 2 also. While the invention is particularly applicable for use with a waterwall panel 16, the invention is not restricted for use with a waterwall panel 16, but may also be used with a wide variety of other complicated metal shapes or convoluted metal surfaces.

The induction coil assembly 10 includes a tubular structure shown generally by reference numeral 20 which functions as a combined electric current conductor and conduit for circulating cooling fluid. The structure 20 is of electrically conductive material, such as copper. While the structure 20 may have a wide variety of cross-sectional configurations, preferably—as illustrated in the drawings—it is substantially quadrate (that is substantially rectangular or square) in cross-section. While the structure 20 may be formed as an integral structure, and may in plan (as seen somewhat in FIG. 1 and most clearly in FIG. 3) define an open interior volume 21 that is also substantially quadrate in configuration, it may alternatively be formed as a substantially closed loop, or have another curvature or shape.

Figure 3:
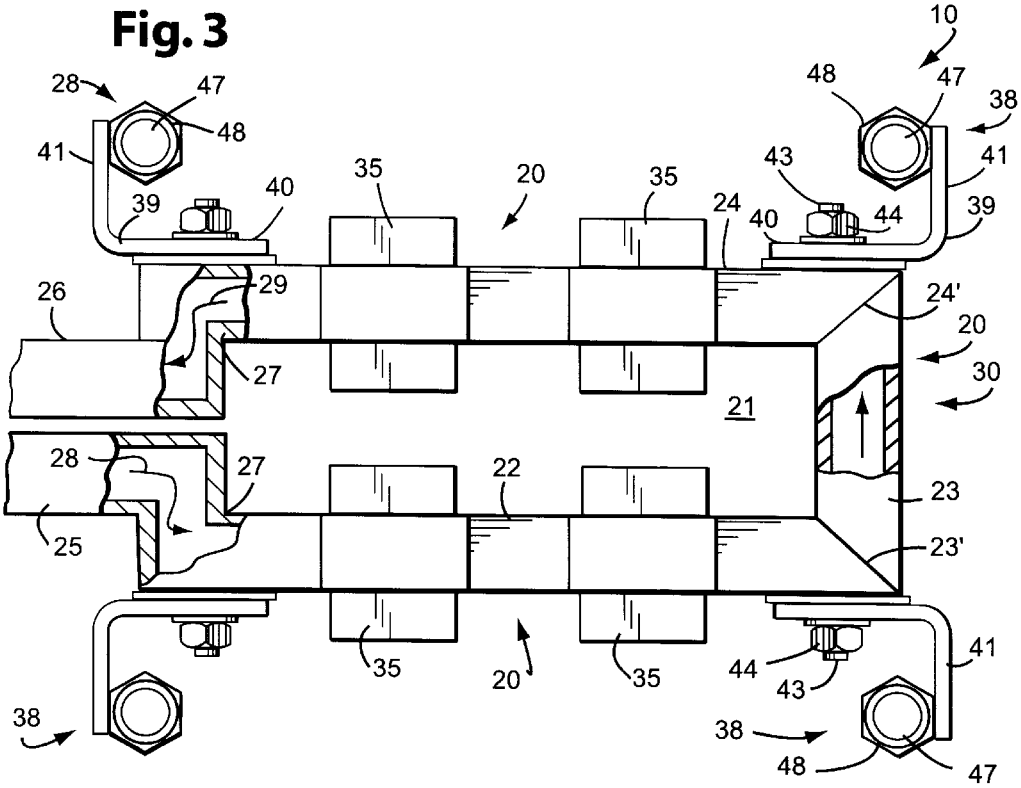
FIG. 3 is a top view, with portions cut away to illustrate the internal passages, of the induction coil assembly of FIG. 2.

When constructed as illustrated in FIGS. 1 through 3 the structure 20 is typically formed by three different sections 22, 23, and 24, which sections may be joined together—as illustrated at joints 23', 24'—with a silver brazing alloy. The sections 22, 24 may also be joined to hollow supporting legs 25, 26, respectively, as indicated at 27 in FIG. 3, by silver brazing alloy. The hollow legs 25, 26 are also preferably of copper and have substantially the same cross section as the structure 20, and supply current to the induction coil assembly 10 and circulate cooling fluid (typically water) to and from the induction coil assembly 10, as illustrated by the arrows 28, 29 in FIG. 3.

The induction coil assembly 10 has a first closed end 30, formed by the component 23 in the exemplary embodiment illustrated in the drawings, and a second end connected to the source of cooling fluid 13 and a source of electricity, such as the transformer 11 and power supply 12. The connection to elements 11–13 is preferably made through the legs 25, 26, and then through the conduits 14, 15, and by any suitable electrical connector—shown generally at 31 in FIG. 1—to the transformer 11 and power supply 12.

Figure 4:
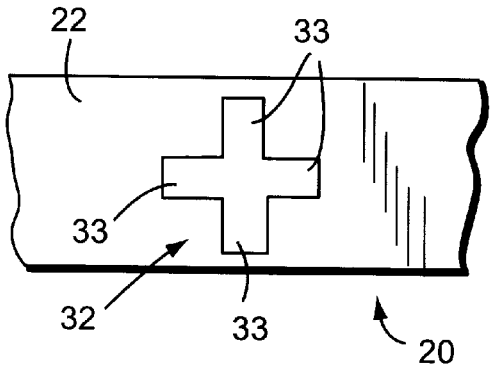
FIG. 4 is a bottom plan view, with the flux concentrator removed for clarity of illustration, of a nose of the induction coil assembly of FIGS. 1 through 3.

The induction coil assembly 10 also includes at least one electrically conductive material nose, shown at 32 in FIG. 2, extending outwardly from the structure 20. The nose 32 extends substantially perpendicularly to one of the portions 22, 24, and is configured—as illustrated in FIG. 2—so as to effect induction heating of at least two differently configured portions of a complicated metal shape or convoluted metal surface, in the case of the FIG. 2 embodiment induction heating three surfaces, namely the tube 17 walls on either side thereof, and the membrane 18 beneath it. While the nose 32 may have a wide variety of constructions and be made of a wide variety of materials, in the preferred embodiment illustrated preferably it comprises four tubular copper radiators 33 (see FIGS. 2 and 4) that are both electrically connected to the portion 22 of the structure 20, and mechanically connected to the cooling fluid flowing in the interior thereof. The noses 32 of FIG. 2 have a configuration similar to that of a square based pyramid, but may alternatively be truncated cones or have other pyramid or tapered shapes.

While for some purposes and for some constructions the nose 32 is used per se to form, or to assist in forming, an appropriate fused coating, in the preferred embodiment illustrated in FIGS. 1 through 3 each of the plurality of noses 32 (or at least some of the plurality of noses 32) is or are covered by a flux concentrator 35. [In FIG. 2 the flux concentrator 35 for the rightmost nose 32 has been cut away so as to illustrate the nose 32, but typically a flux concentrator 35 is provided on each nose.] For the embodiment illustrated in FIGS. 1 through 3 four noses 32 with associated flux concentrators 35 are provided, although almost any number can be provided as long as they function properly.

Both cooling fluid and electrical current pass through the fusing noses 32, generating enough surface temperature on the tubes 17 and membrane 18 (up to 2200° F.), and therefore fuse the coating [60] on the tube and membrane simultaneously, as illustrated in FIGS. 1 and 2, and the shape of the nose 32 is configured for the particular purpose for which it will be used and depending upon the shape of the waterwall panel 16, or other complicated metal shape or convoluted metal surface with which it will be used. The flux concentrator 35 which covers the nose 32 enhances the heat distribution to the "valley" into which each nose 32 extends, as illustrated in FIG. 2. The flux concentrator 35 may be of conventional ferrite material, or of a magnetodielectric material. Magnetodielectric materials are made from magnetic particles and a dielectric material which serves as a binder and insulator, and are pressed to form any shape desired. The dielectric material should form a solid machinable material.

Each flux concentrator 35 is formed and/or cut according to the heat pattern and contour to be applied and associated therewith. After proper formation and/or cutting, the concentrator 35 is attached to the structure 20 and/or to the nose 32 with which it is associated (preferably just to one of the elements 22, 24 of the structure 20) so that it is physically secured thereto and in thermal contact therewith. This attachment is preferably provided using a thermally conductive adhesive, such as that sold commercially under the trade name AREMCO 805. The heat conductive adhesive transfers the heat generated in the flux as well as radiant heat from the heated tube 17 surfaces to the structure 20 and subsequently to the cooling fluid circulating as indicated by arrows 28 and 29 in FIG. 3, which prevents the concentrator 35 from burning up.

In order to have smooth and continuous fusion, it is highly desirable to provide a structure which facilitates movement of the coil 10 along the waterwall panel 16 or like surface with which it is to be used so that the structure 20, and associated noses 32 and concentrators 35, are positioned on the waterwall 16 a consistent distance from the tube 17/membrane 18 surfaces. One exemplary way of effecting this purpose is to utilize the four supporting guide structures indicated generally by reference numerals 38 in FIGS. 1 through 3, the structures 38 in the preferred embodiment illustrated in the drawings positioned at the "corners" of the coil assembly 10 so as to positively support all of the flux concentrators 35 and the noses 32 in a desired position with respect to the waterwall panel 16, and to facilitate easy and uniform movement over the panel 16. A roller system or manipulator (not shown) may be used to facilitate movement of the coil assembly 10 longitudinally along the length of the tubes 17 in a waterwall panel 16. In the embodiment illustrated in FIGS. 1 through 3 each of the structures 38 comprises an angled bracket 39 having one leg 40 thereof connected to an outer side wall of one of the portions 22, 24, and having the other leg 41 thereof connected to a guide 42. The legs 40 may be connected to the structures 22, 24 by brazing, or—as illustrated in FIGS. 1 through 3—by bolts 43 integral with the structures 22, 24 and extending outwardly therefrom, and nuts 44 screwed onto the bolts 43.

In the embodiment illustrated in the drawings the guides 42 comprise shanks 45 having rounded heads 46 dimensioned and configured to fit within a "valley" (that is in the embodiment illustrated in FIG. 2 engaging the membrane 18) of the panel 16, and having a screw threaded upper portion 47. The screw threaded upper portion 47 is screw threaded into a nut 48 welded or otherwise rigidly attached to the leg 41 of bracket 39 so that the vertical position of the head 46 may be adjusted, as indicated by the arrows 49 in FIG. 2. This allows fine adjustment of the position of each corner of the coil assembly 10, and thus all of the flux concentrators 35, so that they are in an optimum position, as illustrated in FIG. 2.

While the supporting guide structures 38 illustrated in FIGS. 1–3 are preferred, a wide variety of other constructions may be provided, including those having rollers, "skis", skids, or the like, and mounted by any suitable mechanism including almost any conventional type bracket, hinge, flange, or support, with any suitable conventional adjustment mechanism including detents, clamps, quick release and engage fasteners, or the like.

Figure 5:
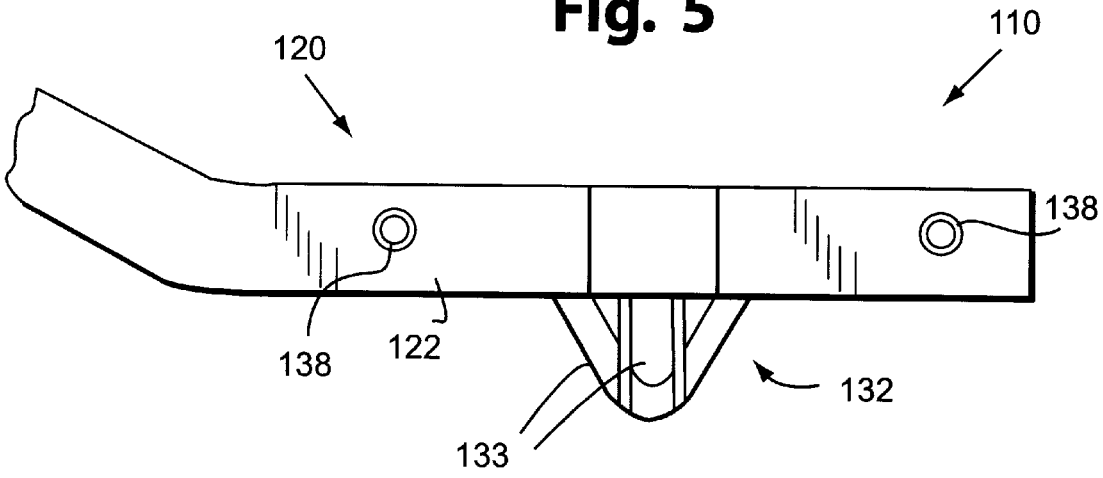
FIG. 5 is a side view of another induction coil assembly according to the invention.

While the induction coil assembly 10 may be used alone in the practice of the method according to the present invention, alternatively it may be used with a preheat induction coil assembly, shown schematically at 110 in FIG. 5, structures in FIG. 5 roughly corresponding to those in FIGS. 1 through 4 being shown by the same reference numeral only preceded by a"1". The preheat induction coil assembly 110 preferably has a plan configuration very similar to that illustrated in FIG. 3 including having a combined conductor and conduit structure 120 with various portions thereof, only the portion 122 being clearly illustrated in FIG. 5. One or more preheat noses 132, formed by copper radiators 133, extend downwardly from the portion 122 (and associated portion corresponding to the portion 24 in the FIGS. 1 through 4 embodiment). However the nose or noses 132 are uncovered by a flux concentrator 35. Studs 138 may extend outwardly from the structure 120 to support guides which may have a construction similar to that described with respect to the FIGS. 1 through 4 embodiment.

Alternatively instead of providing a different preheat induction coil 110 from the fusing coil 10, the noses 32 associated with one of the structures 22, 24 may be uncovered and provide a preheat zone while the noses associated with the other structure 22, 24 are covered with flux concentrators 35 and provide a fusion zone. This will be described in more detail with respect to the FIG. 6 embodiment.

Regardless of whether one coil 10 or two coils 110 are provided, according to one method of fusing a coating to the panel 16 the "preheater" nose (e.g. 132) or noses extend down to the membrane 18 fitting in the contour between tubes 17 and the associated membrane 18, and are passed over panel 16, preheating that contour. The noses 32 with flux concentrators 35 then pass over the preheated contour of the panel 16 and the copper nose 32 with concentrator 35 supplies sufficient inductive energy to the membrane 18 so as to fuse a coating on the membrane 18 without overheating the coating on the tube 17 (which is difficult with conventional flame techniques). The copper nose 32 brings the inductive current into the "valley" between the tubes 17, while the magnetic flux concentrator 35 significantly improves the usage of power which will transfer to the membrane 18. This allows the distribution of magnetic and inductive current to be precisely controlled so as to control the heating pattern in the tube 17 and membrane 18 areas so that there is no significant warpage or adverse change in the microstructure of the material forming the waterwall panel 16.

The speed at which the coil 10, 110, is moved across the panel 16 can be controlled by a simple drive motor, or manually by an operator holding the handle 51 of heat and electrical insulating material, the coil assembly 10 being moved in the direction of the arrows 52 illustrated in FIG. 1.

When utilizing a coil assembly 10, 110 according to the present invention a panel 16 as large as twenty feet by one hundred feet can be properly acted upon for tubes 17 having almost any dimensions (e.g. having an outside diameter of 0.5–3 inches, e.g. 1.5 inches). The coil assembly 10 may be used in the field to fuse the coating and preferably the transformer 11 is compact and is located close to the handle 51 at the general area of the waterwall panel 16 and remote from the high frequency power supply 12 (e.g. the method according to the invention may be practiced at a distance of more than thirty feet from the power supply 12). The mechanism, shown schematically at 13, for circulating the cooling fluid, such as water, may comprise any conventional pump/cooler/radiator configuration that will effectively perform its task and is not, per se, part of this invention. The structure 13 may also be portable and movable around (e.g. on a cart) with the transformer 11 and, if necessary, connected by flexible tubing to a source of cool water and/or a drain or radiator.

The combination transformer 11 and power supply 12 preferably provides high frequency induction heating, that is about 25 Hz or more. This allows effective fusing while minimizing warpage of the panel 16 components.

A coating that is fused to the panel 16 is illustrated only partially and schematically at 60 in FIGS. 1 and 2. However it is to be understood that preferably the coating 60 will be fused substantially continuously over substantially the entire top face of the panel 16, as seen in FIGS. 1 and 2. The coating 60 material may be any conventional commercial self-fusing alloy thermal spray, such as nickel based alloys which may or may not have boron and/or silicon therein. During fusion the coating 60 will form a brazed or glossy surface that has a very smooth appearance. The coating 60 thickness typically ranges from 3–40 mils when a nickel based alloy is utilized, and after the fusing action the coating 60 and the panel 16 substrate achieve a metallurgical bond. The fusion temperature for typical self-fusing nickel based alloys ranges from about 1800° F. to about 2200° F., depending on the flux concentration of boron and/or silicon, or other materials, present in the coating 60.

Alternatively the coating 60 may comprise a vitreous ceramic coating. Typical ceramic coating thicknesses are about 3–15 mils. Any suitable conventional vitreous ceramic coating may be utilized, such as proprietary coatings of Fosbel Inc. of Berea, Ohio which are mainly composed of low melting point frits and an inorganic binder. Such coatings are typically applied by spraying or painting them on the panel 16 in a slurry form and, after air drying, heating them with the coil assembly 10 or the coil assemblies 110, 10. Here the typical fusion temperature is between about 1000°–2200° F.

According to one aspect of the present invention a method of fusing a self-fusing alloy thermal spray coating or a vitreous ceramic coating on a waterwall panel 16 having a plurality of tubes 17 and connected by a plurality of membranes 18 is provided. The method comprises the steps of: (a) heating at least some portions of at least one membrane 18 and adjacent tubes 17 of the panel 16, by induction, to a liquidus temperature (typically 1000°–2200° F.) of a self-fusing alloy thermal spray coating or a vitreous ceramic coating without significant warpage or adverse change in the microstructure of the material forming the panel 16. And applying a self-fusing alloy thermal spray coating 60 or a vitreous ceramic coating 60 on the waterwall panel 16 so that the coating 60 is fused at the heated portions of the panel 16. Preferably, or necessarily, step (b) is practiced first, typically by spraying but in some circumstances by painting, and the coating is typically allowed to air dry before step (a) is practiced. Step (a) is typically practiced by concentrating the induction energy in the membrane 18 portion of the waterwall 16, by passing the coil assembly 10, or coil assemblies 110, then 10, over the panel 16 as indicated by the directional arrows 52 in FIG. 1. The guides 42 properly position the noses 32 and/or flux concentrators 35 with respect to the panel 16, as illustrated in FIG. 2, during movement over the panel 16. The speed of movement in the direction 52 must be such that the panel 16 or coating 60 are not overheated, as could occur if the coil assembly 10 was held in one place.

The inductive heating of step (a) preferably takes place at a frequency of greater than 25 kHz, appropriate electrical current being provided by the power supply 12, transformer 11, electrical connector 31, and legs 25, 26 to the coil 10. Cooling water is circulated, as indicated by arrows 28 and 29 in FIG. 3, from the pump 13 through conduit 15 and leg 25 and back from the coil 10 through leg 26 and conduit 14.

Movement in the direction 52 is accomplished by an operator manually holding the insulated handle 51, or by connecting the legs 25, 26 up to a suitable small electric drive motor with an conventional drive mechanism (such as a screw and traveling nut) that reciprocates the coil 10 at the desired speed in the dimension 52.

Figure 6:
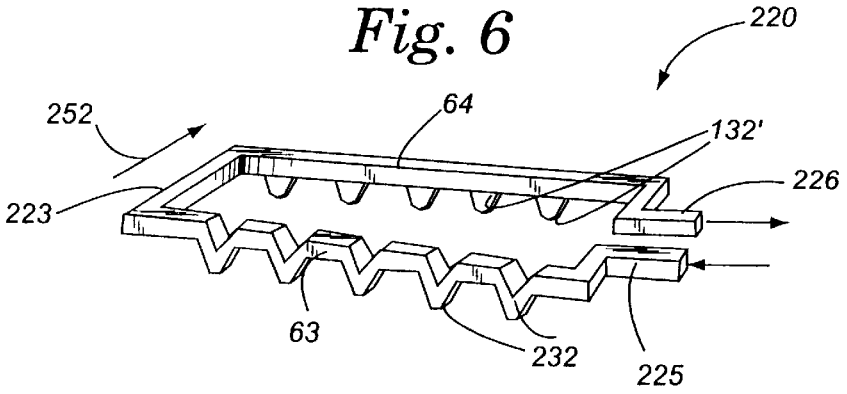
FIG. 6 is a perspective schematic view showing another embodiment of an exemplary induction coil assembly according to the present invention.

FIG. 6 schematically illustrates another exemplary induction coil assembly according to the present invention. Components similar to those in the FIGS. 1 through 3 embodiment are shown by the same reference numerals and are preceded by a "2", or to the extent similar to the FIG. 5 embodiment are indicated by the same reference only followed by a prime. The induction coil assembly 220 has a first end with a combined structure 225 for circulating cooling fluid and for supplying electricity is connected to a first portion 63 of a loop formed by the combined conductor and fluid circulator, the first portion 63 acting as a trailing portion when the assembly 220 is in normal use, and is moved in the direction of arrow 252. First portion 63 has a plurality of fusing/induction heating noses 232 extending downwardly therefrom which are adapted to move in the valleys between the tube 17 connected to the membrane 18, as illustrated for the assembly 20 in the FIG. 2 embodiment. Though not shown in FIG. 6, preferably the fusing noses 232 have a flux concentrator, like the flux concentrator 35 in the FIGS. 1 through 3 embodiment, thereon.

The loop forming the assembly 220 includes a cross piece 223, and then a second, leading (during normal use) portion 64. The portion 64 includes a plurality of preheating noses 132' extending downwardly therefrom. Rather than the preheating noses 132' being bent portions of the combined conduit and electrical conductor, as for the fusing noses 232, the preheating noses 132' are typically solid blocks of copper or other conductive material which are brazed or otherwise attached to the bottom of the second portion 64. The preheating noses 132' are devoid of flux concentrators. The circulating fluid, and a path for return of the electricity to the power supply, are provided by the portion 226 of the assembly 220.

While in FIG. 6 no supporting guide or roller structure is illustrated, it is to be understood that supporting guide assemblies such as illustrated in FIGS. 1 through 3 embodiment, or a roller assembly or like structure, for facilitating movement of the assembly 220 in the direction 252, may be provided.

Utilizing the apparatus of FIG. 6 it is a simple matter to practice the method step of inductive heating at least a portion of a complicated metal or convoluted metal surface by induction heating at a frequency greater than about 25 kHz to at least the liquidus temperature of the coating by first passing a preheater (with at least one copper nose 132' and without a flux concentrator so that it substantially conforms to the convoluted metal surface or complicated metal shape (as seen in FIGS. 1 and 2)) over the panel 18, and then, in the same movement since the structures are unitary, and one immediately follows the other, passing a fusion coil assembly including fusion noses 232 (with magnetic flux concentrators 35) substantially conforming to the convoluted metal surface or complicated metal shape, over the panel 18 so as to effect fusing of the coating 60.

Figure 7:
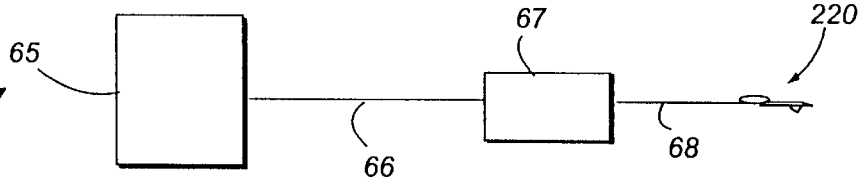
FIGS. 7, 8 and 9 are schematic representations of various connections of power supplies, capacitors, transformers, and coil assemblies that may be utilized according to the present invention.
Figure 8:
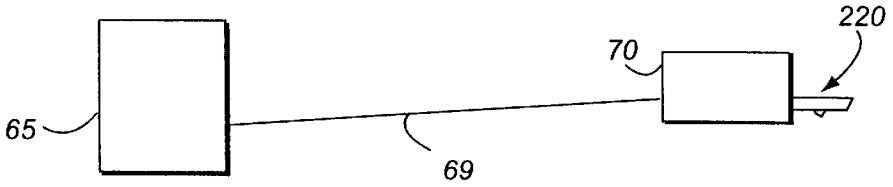
Figure 9:
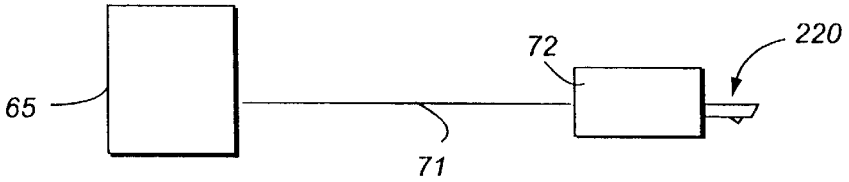

FIGS. 7 through 9 show—very schematically—various other general system arrangements for components to be used in the practice of the present invention. The components illustrated in FIGS. 7 through 9 differing somewhat from the configuration illustrated in FIG. 1.

FIG. 7 shows an electrical power supply 65 connected by electrical cord 66 to a capacitor station and/or transformer 67. The lines 66 may be up to 100 feet long. The capacitor station and/or transformer 67 is connected by power lines 68 to the coil assembly 220. The lines 68 may be up to fifteen feet long. The cooling water circulation is not seen in FIG. 7, but is also provided.

In the FIG. 8 embodiment electrical power supply 65 is connected via line 69 to a capacitor station 70 on which the coil assembly 220 is mounted. The line 69 may have a length of up to 150 feet.

FIG. 9 shows an embodiment in which electrical power supply 65 is connected up by lines 71 to a hand-held transformer 72 to which the coil assembly 220 is connected. The lines 71 may have a length of up to 50 feet.

Figure 10:
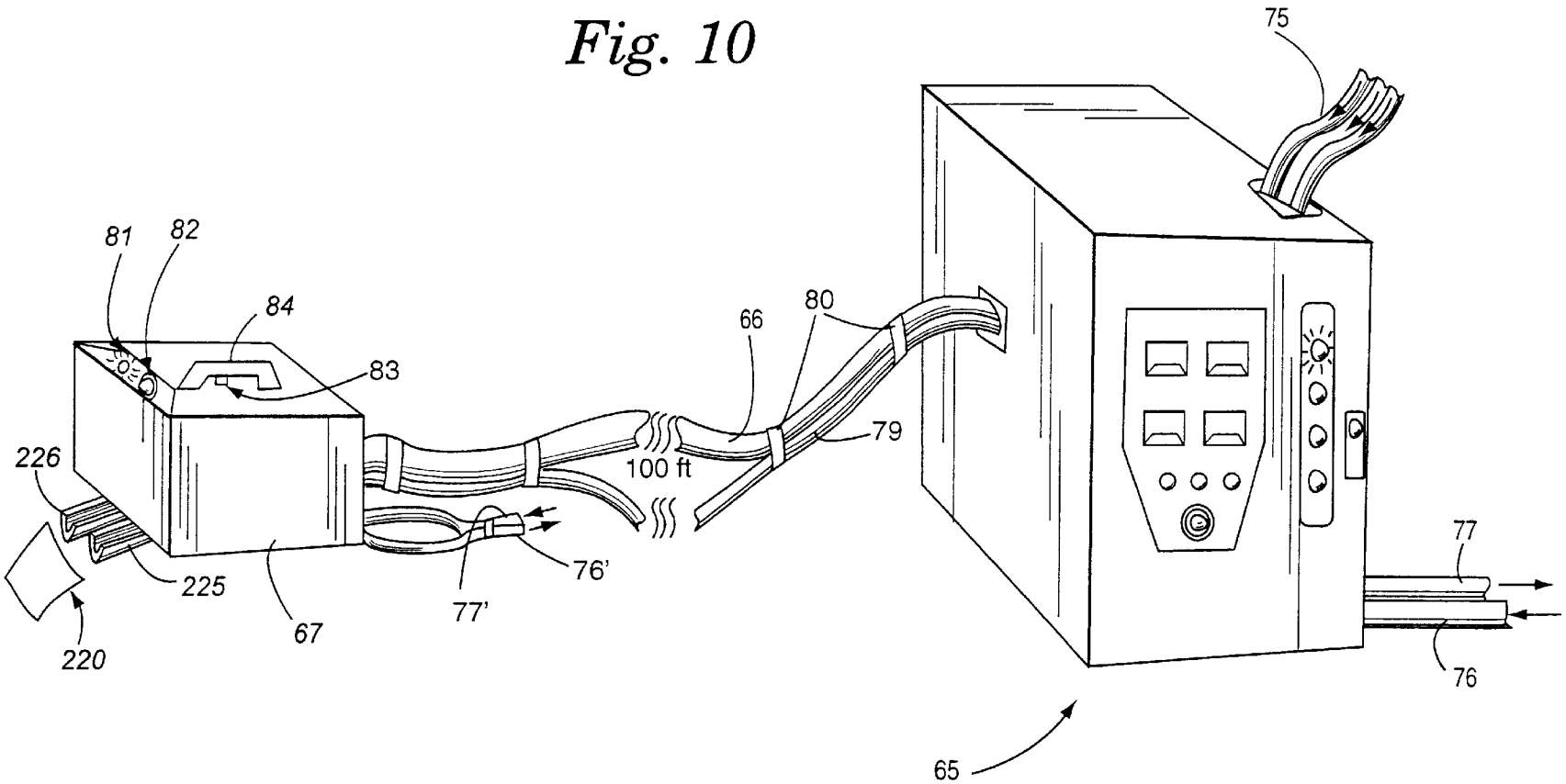
FIG. 10 is a more detailed schematic perspective view of the configuration illustrated in FIG. 7.

FIG. 10 shows schematically, but in more detail, the general system such as illustrated in FIG. 7, having common reference numerals with FIG. 7. The power supply 65 preferably comprises a 50 kw/50 kHz power supply, having 480 volt three phase electrical lines 75 connected thereto. Water or like cooling fluid in the conduit 76, e.g. from a pump/cooler (such as a structure 13 in FIG. 1), and an outlet conduit 77, may also be lead into the same casing for the power supply 65 and are ultimately connected to the water hoses 76', 77' which lead to the capacitor station and/or transformer 67.

The line 66 may comprise a coaxial cable and may have a control signal line 79 banded thereto with conventional plastic bands 80, or tape. As indicated above, the lines 66, 79 may be up to 100 feet long.

The station 67 includes a power LED indicator 81 and a remote level control 82, as well as a remote start switch 83 and a handle 84.

It will thus be seen that according to the present invention an advantageous method of fusing a self-fusing alloy thermal spray coating or a vitreous ceramic coating to a complicated metal shape or convoluted metal surface, such as a waterwall panel, as well as various embodiments of an advantageous inductive coil assembly for practicing the method, have been provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation methods, and devices. of the appended claims so as to encompass all equivalent structures,

What is claimed is:

1. A method of fusing a self-fusing alloy thermal spray coating or a vitreous ceramic coating on a waterwall panel having a plurality of tubes interconnected by a plurality of membranes, using a movable induction coil assembly comprising the steps of:

(a) heating at least some portions of at least one membrane and adjacent tubes of the waterwall panel, by induction, to a liquidus temperature of a self-fusing alloy thermal spray coating or a vitreous ceramic coating without significant warpage or adverse change in the microstructure of the material forming the waterwall panel by moving the induction coil assembly across the panel so that the induction coil assembly concentrates induction energy in at least one membrane; and (b) applying a self-fusing alloy thermal spray coating or a vitreous ceramic coating on the waterwall panel in such a way that the coating is fused at the portions of the panel heated pursuant to step (a).

2. A method as recited in claim 1 wherein step (b) is practiced before step (a).

3. A method as recited in claim 2 wherein induction heating in step (a) is practiced at a frequency of greater than about 25 kHz.

4. A method as recited in claim 2 utilizing a portable compact transformer or capacitor station connected to a main power supply connected to the induction coil assembly and supplying energy thereto; and wherein step (a) is practiced at a distance of more than thirty feet from the main power supply.

5. A method as recited in claim 2 wherein the waterwall panel has first and second faces; and wherein steps (a) and (b) are repeated so as to fuse the coating substantially continuously over substantially the entire first face of the waterwall panel.

6. A method as recited in claim 2 wherein step (a) is practiced by moving an induction coil assembly having a plurality of noses roughly approximating the contour of the waterwall panel over the panel.

7. A method as recited in claim 6 comprising the further step of circulating a cooling fluid through the induction coil assembly during the practice of step (a).

8. A method as recited in claim 6 wherein induction heating in step (a) is practiced at a frequency of greater than about 25 kHz.

9. A method as recited in claim 8 wherein step (b) is practiced by applying a nickel based alloy having a coating thickness of from 3–40 mils, and step (a) is practiced to heat the coating to a temperature of about 1800–2200° F.

10. A method as recited in claim 2 wherein step (b) is practiced by painting or spraying a composition of frits and an inorganic binder, in slurry form, with a thickness of between 3–15 mils; and comprising the further step of air drying the coating before the practice of step (a).

11. A method as recited in claim 2 wherein step (a) is practiced so as to heat the coating to a temperature of between about 1000–2200° F.

12. A method as recited in claim 2 wherein step (a) is practiced by (i) first passing a preheater coil assembly including a copper nose which extends down to the membrane without a flux concentrator over the panel, and (ii) then passing a fusion coil assembly comprising a copper nose and magnetic flux concentrator which brings sufficient inductive energy to the membrane so that the coating on the membrane can be fused without overheating the coating on the tubes, or the panel.

13. A method as recited in claim 12 wherein substeps (i) and (ii) are practiced using a unitary structure so that (ii) immediately follows (i).

14. A method as recited in claim 1 wherein step (a) is practiced utilizing as the induction coil assembly an electrically conductive material tubular combined electrical current conductor and conduit for circulating cooling fluid having a first closed end, and a second end connectable to a source of cooling fluid and a source of electricity; and at least one electrically conductive material nose extending outwardly from the combined conductor and conduit and both conducting electricity and circulating cooling fluid, the nose extending substantially perpendicularly to the combined conductor and conduit, the nose configured so as to effect induction heating of at least two differently configured portions of the waterwall panel.

15. A method as recited in claim 14 wherein step (a) is further practiced utilizing an induction coil assembly wherein the tubular combined conductor and conduit is in the form of a loop having a first portion which acts as a trailing portion in use, and a second portion which acts as a leading portion in use; and wherein the at least one nose for induction heating is on the first portion, and further comprising at least one preheating nose on the second portion.

16. A method as recited in claim 1 wherein step (a) is further practiced utilizing a transformer or capacitor system and a greater than about 25 kHz induction power supply electrically connected to the induction coil assembly, and so that the transformer or capacitor system remains stationary while the induction coil assembly is moved.

17. A method of fusing a self-fusing alloy thermal spray coating or a vitreous ceramic coating on a complicated metal shape or convoluted metal surface having at least two differently configured portions, using a movable induction coil assembly, comprising the steps of:

(a) applying a self-fusing alloy thermal spray coating or a vitreous ceramic coating on the complicated metal shape or convoluted metal surface so that the coating is fused at a subsequently heated portion thereof; and then (b) inductive heating at least a portion of the complicated metal shape or convoluted metal surface by induction at a frequency of greater than about 25 kHz to at least the liquidus temperature of the coating by moving the induction coil assembly across the complicated metal shape or convoluted metal surface so that the induction coil assembly heats at least two differently configured portions of the complicated metal shape or convoluted metal surface.

18. A method as recited in claim 17 wherein the coating is dry before step (b) is practiced, and wherein step (b) is practiced by moving an induction coil assembly having a plurality of noses roughly approximating the contour of the over the complicated metal shape or convoluted metal surface.

19. A method as recited in claim 17 wherein step (a) is practiced by applying a nickel based alloy having a coating thickness of from 3–40 mils.

20. A method as recited in claim 17 wherein step (a) is practiced by painting or spraying a composition of frits and an inorganic binder, in slurry form, with a thickness of between 3–15 mils; and comprising the further step of air drying the coating before the practice of step (b).

21. A method of fusing a self-fusing alloy thermal spray coating or a vitreous ceramic coating on a complicated metal shape or convoluted metal surface comprising the steps of:

(a) applying a self-fusing alloy thermal spray coating or a vitreous ceramic coating on the complicated metal shape or convoluted metal surface so that the coating is fused at a subsequently heated portion thereof; and then (b) inductive heating at least a portion of the complicated metal shape or convoluted metal surface by induction at a frequency of greater than about 25 kHz to at least the liquidus temperature of the coating; and wherein step (b) is practiced by (i) first passing a preheater with at least one copper nose and without a flux concentrator so that it substantially conforms to the convoluted metal surface or complicated metal shape, and (ii) then passing over the surface or shape a fusion coil assembly having at least one copper nose with a magnetic flux concentrator substantially conforming to the convoluted metal surface or complicated metal shape so as to effect fusing; and wherein substeps (i) and (ii) are practiced using a unitary structure.

* * * * *